United States Patent [19]

D'Amour et al.

[11] Patent Number: 4,554,798

[45] Date of Patent: Nov. 26, 1985

[54] BOTTLE COOLING DEVICE

[76] Inventors: Richard D'Amour, 1625 des Merisiers, Côte Ste. Catherine, Quebec, Canada, J0L 1E0; Ronald D'Amour, 5 Belanger, St. Constant Quebec, Canada, J0L 1X0

[21] Appl. No.: 580,010

[22] Filed: Feb. 14, 1984

[51] Int. Cl.[4] ..... F25D 3/08

[52] U.S. Cl. ..... 62/457; 62/530

[58] Field of Search ..... 62/457, 530, 371

[56] References Cited

U.S. PATENT DOCUMENTS

| | | | |
|---|---|---|---|
| 1,310,161 | 7/1919 | Johnson | 62/371 |
| 1,984,030 | 12/1934 | Nixon | 62/142 |
| 3,365,911 | 1/1968 | Stoner et al. | 62/457 |
| 3,401,535 | 9/1968 | Palmer | 67/457 |
| 4,266,407 | 5/1981 | Gibson | 62/371 |
| 4,324,111 | 4/1982 | Edwards | 62/457 |

FOREIGN PATENT DOCUMENTS

| | | | |
|---|---|---|---|
| 678418 | 7/1929 | France | 62/457 |

*Primary Examiner*—William E. Wayner

*Attorney, Agent, or Firm*—Schwartz, Jeffery, Schwaab, Mack, Blumenthal & Evans

[57] ABSTRACT

A device for cooling a plurality of liquid-filled bottles comprises a container made of a rigid pressure-expandable plastic material and having therein a refrigerant material. The container has top and bottom surfaces and is formed with a plurality of through-holes which extend between the top and bottom surfaces and are each associated with a respective one of the bottles to be cooled. Each through-hole is adapted to receive the neck of its associated bottle and has an inner peripheral wall with at least a surface portion thereof adapted to contact an upper portion of the associated bottle for the cooling thereof.

19 Claims, 7 Drawing Figures

BOTTLE COOLING DEVICE

BACKGROUND OF THE INVENTION

This invention relates to a bottle cooling device. More particularly, the invention is directed to a device for cooling liquid-filled bottles, such as beer bottles.

Many bottled beverages are better drunk cold, especially beer, and while it is conventional to cool them in a refrigerator, it has usually been the practice when going outdoors to place the bottles in a portable ice cooler containing one or more ice packs so as to keep the contents of the bottles cold. Such ice coolers are generally heavy and awkward to carry around, in addition to taking considerable space.

Various devices have already been proposed for cooling bottles. For example, in U.S. Pat. No. 3,365,911, there is described a bottle cooling device comprising a stand provided with an inclined tray of W-like cross-section supporting a pair of hollow capsules containing a liquid refrigerant material. Each capsule has an inner arcuate surface adapted to engage a circumferential portion of the bottle to be cooled, which extends from the bottom of the bottle to its neck. Such a cooling device is particularly suited for wine bottles since the arrangment of the capsules enables the label on the front of the bottle to be displayed.

U.S. Pat. No. 4,324,111, on the other hand, proposes a freezing gel containment structure comprising a plurality of adjacent tubes secured together in edgewise relationship and each separately filled with freezing gel. In one embodiment, this structure is sandwiched between two sheets of flexible material which are sealed together adjacent their edges to form a refrigerant panel. Two such panels may then be secured to a circular base for receiving therebetween a bottle to be cooled.

Thus, the bottle cooling devices proposed so far can only be applied to one bottle at a time. It would of course be highly desirable to have a bottle cooling device designed for a pack of bottles, such as a 6-pack of beer bottles contained in a case, and which could also be conveniently fitted in the case itself for easy transportation thereof while keeping the bottles cold at any time.

SUMMARY OF THE INVENTION

It is therefore an object of the present invention to provide a device for cooling a plurality of liquid-filled bottles, particularly bottles contained in a receptacle, and which can also be fitted in the receptacle without taking extra space.

In accordance with the invention, there is provided a device for cooling a plurality of liquid-filled bottles, comprising a container made of a rigid pressure-expandable plastic material and having therein a refrigerant material. The container has top and bottom surfaces and is formed with a plurality of through-holes which extend between the top and bottom surfaces and are each associated with a respective one of the bottles to be cooled. Each through-hole is adapted to receive the neck of its associated bottle and has an inner peripheral wall with at least a surface portion thereof adapted to contact an upper portion of the associated bottle for the cooling thereof.

According to a preferred embodiment of the invention which is designed for bottles having a shoulder adjacent the neck thereof, the inner wall of each through-hole has upper and lower peripheral surface portions merging with each other, the lower surface portion being enlarged relative to the upper surface portion and adapted to fit over the shoulder of the bottle so as to rest thereon. This enables the container to be dimensioned so as to fit in a receptacle containing the bottles disposed in an upright position, whereby to be positioned in overlying relationship to the bottles while resting on the shoulders thereof. Owing to such an arrangement, the air surrounding the bottles below the container is also efficiently cooled and since cold air has a greater density it tends to descend along the outer walls of the bottles, thus contributing to the efficient cooling of the latter.

Preferably, the lower peripheral surface portion has a truncated hemispherical shape whereas the upper peripheral surface portion is circular in cross-section. Through-holes with such a configuration can accommodate the majority of the bottles on the market, whether being of the short- or long-necked type.

The container can be made of any suitable plastic material which is rigid but yet expandable under pressure at freezing temperatures so as to prevent the container from bursting when the refrigerant material contained therein changes from liquid state to solid state and increases in volume. Examples of such plastic material are polyethylene and polypropylene.

The bottle cooling device of the invention can be fabricated according to the well known blow-molding and rotational molding techniques, at a relatively low cost.

Where the cooling device of the invention is used for cooling beer bottles contained in a cardboard case, it conveniently fits over the tops of the bottles inside the case while allowing the lid to be closed thereover. Since the cardboard lid has thermal insulating properties, the coldness is thus efficiently kept inside the beer case. It has been found in practice when using a freezing gel as refrigerant material that at an ambiant air temperature of about 22° C., the device of the invention can efficiently keep a pack of bottles cold for a period of about 12 hours. At an ambiant air temperature of about 30° C. (dry conditions), the bottles can be kept cold for about 6 hours whereas at about 32° C. and 100% relative humidity the period is reduced to about 3 hours.

BRIEF DESCRIPTION OF THE DRAWINGS

Further features and advantages of the invention will become more readily apparent from the following description of preferred embodiments thereof as illustrated by way of examples in the accompanying drawings, in which.

DESCRIPTION OF PREFERRED EMBODIMENTS

Figure 1:
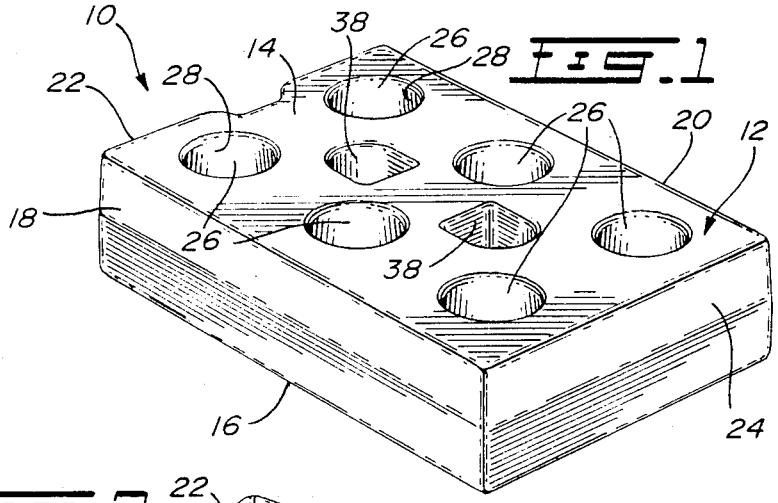
FIG. 1 is a perspective view of a bottle cooling device according to a preferred embodiment of the invention.
Figure 2:
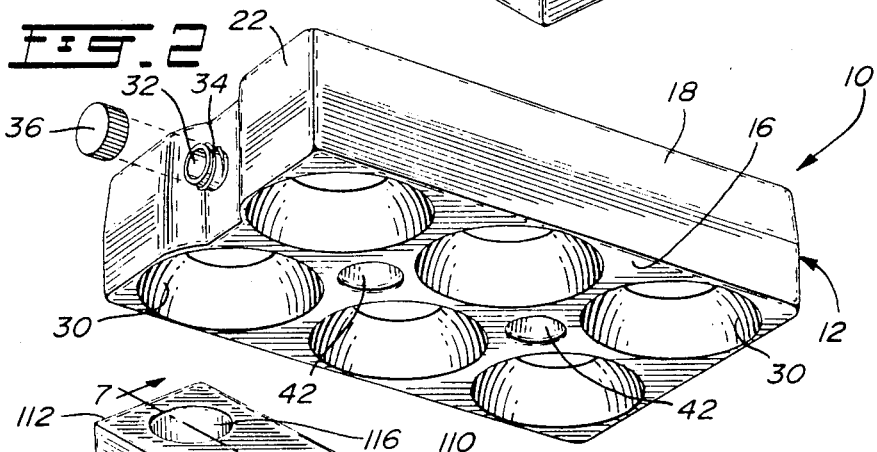
FIG. 2 is another perspective view of the bottle cooling device shown in FIG. 1.

Referring first to FIGS. 1 and 2, there is shown a bottle cooling device 10 for cooling a plurality of bottles, which comprises an elongated plastic container 12 of rectangular configuration having top and bottom surfaces 14,16 which extend in planar parallel relationship, as well as lateral sidewalls 18,20 and end walls 22,24. The container 12 is formed with a plurality of identical through-holes 26 which extend normal to the top and bottom surfaces 14,16 and are each associated with a respective one of the bottles to be cooled. In the embodiment shown, there are 6 through-holes 26 arranged in pairs along the length of the container 12 and the device 10 is thus adapted for a 6-pack of bottles.

Figure 4:
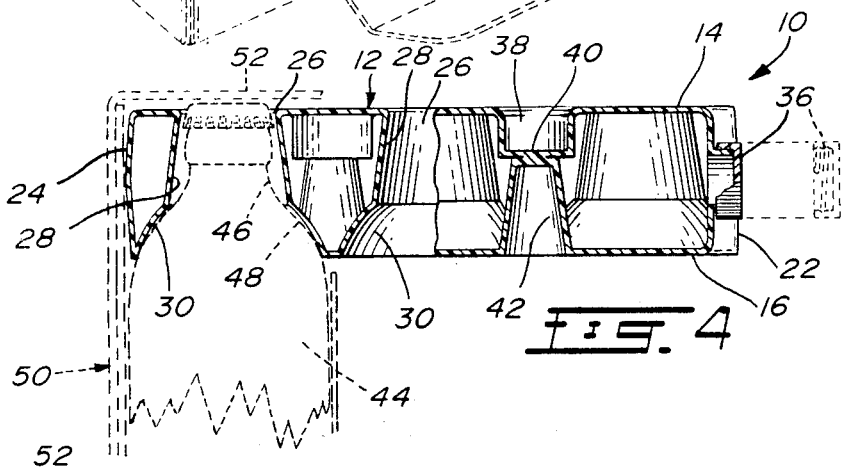
FIG. 4 is a sectional view taken along line 4—4 of FIG. 3.

The inner peripheral wall of each through-hole 26 has an upper surface portion 28 and a lower surface portion 30 which merge with each other. The upper peripheral surface portion 28 is circular in cross-section whereas the lower peripheral surface portion 30 has a truncated hemispherical shape. The surface portion 28 tapers towards the top surface 14, as best shown in FIG. 4.

The end sidewall 22 of the container 12 is formed with an opening 32 through which a refrigerant material capable of being frozen may be inserted. Water may be used as refrigerant material, but the conventional freezing gels are preferred. A threaded neck 34 is provided so that a removable screw cap 36 may be fitted thereover for closing the opening 32 to retain the refrigerant material inside the container 12.

A pair of spaced-apart blind-holes 38 serving as finger gripping means extend inwardly of the container 12 from the top surface 14. In order to prevent the bottom walls 40 of the blind-holes 38 from deforming when the refrigerant material inside the container 12 is subjected to freezing, a pair of projections 42 are provided which extend inwardly of the container 12 from the bottom surface 16 and are each secured to the bottom wall 40 of a blind-hole, as best shown in FIG. 4. The projections 42 thus serve as wall restraining means for restraining each bottom wall 40 against deformation.

Figure 3:
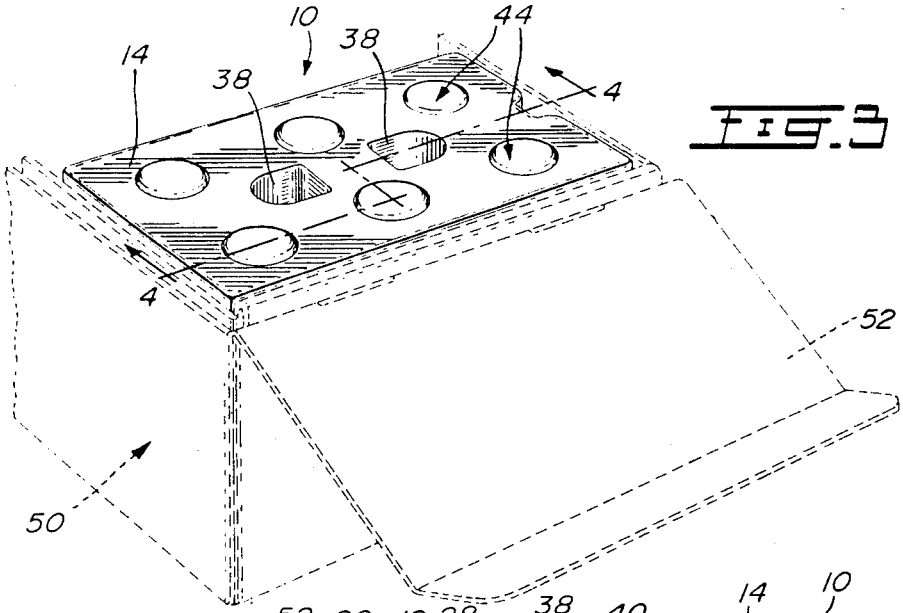
FIG. 3 is a further perspective view showing how the device of FIG. 1 can be positioned inside a case of bottles for keeping the contents of the bottles cold.

In use, the bottle cooling device 10 is first placed in a refrigerator so that the refrigerant material contained therein undergoes freezing. As shown in FIGS. 3 and 4, it may thereafter be fitted over the tops of the bottles 44 to be cooled, such that the necks 46 of the bottles are slipped through the holes 26. In the case of the short-necked bottles 44, the lower peripheral surface portion 30 of the through-hole 26 fits over the bottles shoulder 46 so as to rest thereon. The bottle cooling device 10 conveniently fits inside the cardboard case 50 containing the bottles 44 and is thus positioned in overlying relationship to the bottles while resting on the shoulders thereof. Since the device 10 takes no extra space, the lid 52 of the case 50 may closed thereover, as shown in FIG. 4. Due to the thermal insulating properties of the cardboard lid 52, the coldness can thus be efficiently kept inside the case 50.

Figure 5:
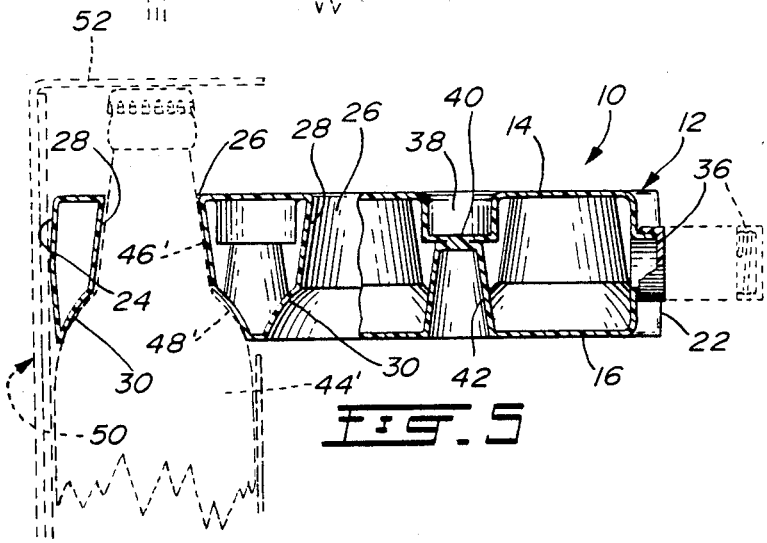
FIG. 5 is a sectional view similar to FIG. 4, but showing how the device of FIG. 1 can be used to cool long-necked bottles.

In the case of long-necked bottles 44' such as shown in FIG. 5, the lid 52 can still be closed since the device 10 is disposed at a lower position over the bottles 44'. As shown, not only does the lower peripheral surface portion 30 of the through-hole 26 rests on the bottle shoulder 48' but the upper peripheral surface portion 28 also contacts the neck 46' of the bottle, thus contributing to the efficient cooling of the latter.

Figure 6:
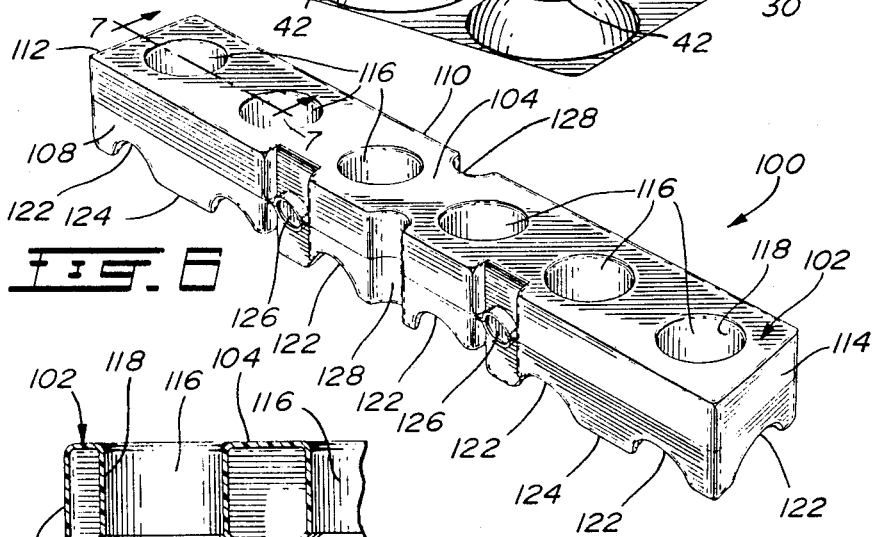
FIG. 6 which is on the same sheet of drawings of FIG. 1 is a perspective view of a bottle cooling device according to another preferred embodiment of the invention.
Figure 7:
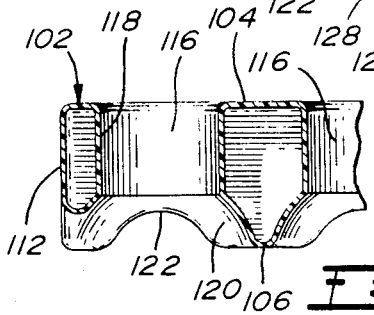
FIG. 7 which is also on the same sheet of drawings as FIG. 1 is a fragmentary sectional view taken along line 7—7 of FIG. 6.

Turning to the embodiment 100 illustrated in FIGS. 6 and 7, the container 102 has an elongated narrow configuration with top and bottom surfaces 104,106 extending in planar parallel relationship, lateral sidewalls 108,110 and end sidewalls 112,114. The through-holes 116 which extend normal to the top and bottom surfaces 104,106 are arranged in a single row along the length of the container 102. As shown in FIG. 7, the upper peripheral surface portion 118 of each through-hole 116 is circular in cross-section but of constant diameter, whereas the lower peripheral surface portion 120 has a truncated hemispherical shape. The lower surface portions 120 of the holes 116 intersect the sidewalls 108, 110, 112 and 114 to form a series of arcuate recesses 122 along the lower peripheral edge 124 of the container 102. A pair of plugs 126 are provided on the lateral sidewalls 108, which are sealed in place after the container has been filled with a refrigerant material. The lateral sidewalls 108 and 110 of the container 102 are each formed with an arcuate cavity 128 which extends between the top and bottom surfaces 104,106. The cavities 128 are arranged opposite one another and serve as finger gripping means.

The bottle cooling device 100 is particularly adapted for beer cases having a partition wall extending lengthwise of the case and dividing the beer bottles in two rows of 6 bottles each.

The bottle cooling device 10 shown in FIGS. 1–5 is intended to be fabricated primarily by rotational molding, whereas the device 100 illustrated in FIGS. 6–7 can be produced by blow-molding as well as by rotational molding, blow-molding being preferred due to its low cost. As it is apparent to those skilled in the art, the bottle cooling device 10 can also be produced by blow-molding, in which case it would be formed with arcuate recesses similar to the recesses 122 of the device 100 shown in FIGS. 6–7.

We claim:

1. A device for cooling a plurality of liquid-filled bottles, comprising a container made of a rigid pressure-expandable plastic material and having therein a refrigerant material, said container having top and bottom surfaces and being formed with a plurality of through-holes which extend between said top and bottom surfaces and are each associated with a respective one of said bottles to be cooled, each said through-hole adapted to receive the neck of its associated bottle therein and having an inner peripheral wall with at least a surface portion thereof adapted to rest on and in contact with an upper portion of said associated bottle for the cooling thereof, and said container being dimensioned to fit in a receptacle containing said bottles disposed in an upright position, whereby to be positioned in relationship to said bottles while resting upon only the upper portion thereof and not supported by the receptacle.

2. A bottle cooling device as claimed in claim 1, designed for bottles having a shoulder adjacent the neck thereof, wherein the inner wall of each said through-hole has upper and lower peripheral surfaces portions merging with each other, said lower surface portion being enlarged relative to said upper surface portion and adapted to fit over the shoulder of the bottle so as to rest thereon.

3. A bottle cooling device as claimed in claim 2, wherein said lower peripheral surface portion has a truncated hemispherical shape.

4. A bottle cooling device as claimed in claim 3, wherein said upper peripheral surface portion is circular in cross-section.

5. A bottle cooling device as claimed in claim 4, wherein said upper peripheral surface portion has a substantially constant diameter.

6. A bottle cooling device as claimed in claim 4, wherein said upper peripheral surfaces portion tapers towards said top surface.

7. A bottle cooling device as claimed in claim 1, wherein said container has an elongated substantially rectangular configuration with said top and bottom surfaces extending in planar parallel relationship, and wherein said through-holes extend normal to said top and bottom surfaces.

8. A bottle cooling device as claimed in claim 7, wherein the inner wall of each said through-hole has upper and lower peripheral surface portions merging with each other, said lower surface portion having a truncated hemispherical shape and said upper surface portion being circular in cross-section.

9. A bottle cooling device as claimed in claim 8, wherein said through-holes are arranged in pairs along the length of said container.

10. A bottle cooling device as claimed in claim 9, further including means for gripping said container by one's fingers.

11. A bottle cooling device as claimed in claim 10, wherein said finger gripping means comprise a pair of spaced-apart blind-holes formed in said container and extending inwardly thereof from said top surface.

12. A bottle cooling device as claimed in claim 11, wherein each said blind-hole has a bottom wall and said container is provided with separate means for restraining each said bottom wall against deformation when said refrigerant material is subjected to freezing.

13. A bottle cooling device as claimed in claim 12, wherein each said wall restraining means comprises a projection extending inwardly of said container from said bottom surface and secured to the bottom wall of a respective one of said blind-holes.

14. A bottle cooling device as claimed in claim 8, wherein said container has an elongated narrow configuration with lateral and end sidewalls and wherein said through-holes are disposed in a single row along the length of said container.

15. A bottle cooling device as claimed in claim 14, wherein the lower peripheral surface portions of said through-holes intersect said sidewalls to form arcuate recesses along a lower peripheral edge of said container.

16. A bottle cooling device as claimed in claim 14, further including means for gripping said container by one's fingers.

17. A bottle cooling device as claimed in claim 16, wherein said finger gripping means comprise a pair of arcuate cavities formed respectively in said lateral sidewalls and extending between said top and bottom surfaces in opposed relationship.

18. A bottle cooling device as claimed in claim 1, wherein said container is formed with an opening for receiving said refrigerant material, a removable closure means being provided for closing said opening so as to retain said refrigerant material inside said container.

19. A bottle cooling device as claimed in claim 1, wherein said refrigerant material is a freezing gel.

* * * * *